US007497928B2

(12) United States Patent
Clark

(10) Patent No.: US 7,497,928 B2
(45) Date of Patent: Mar. 3, 2009

(54) PROCESS OF PRODUCING METALLURGICAL COKE

(75) Inventor: Keith Norman Clark, Kenthurst (AU)

(73) Assignee: Commonwealth Scientific & Industrial Research Organisation, Campbell (AU)

( * ) Notice: Subject to any disclaimer, the term of this patent is extended or adjusted under 35 U.S.C. 154(b) by 502 days.

(21) Appl. No.: 10/503,704

(22) PCT Filed: Feb. 7, 2003

(86) PCT No.: PCT/AU03/00129

§ 371 (c)(1),
(2), (4) Date: Feb. 25, 2005

(87) PCT Pub. No.: WO03/066776

PCT Pub. Date: Aug. 14, 2003

(65) Prior Publication Data

US 2005/0155281 A1 Jul. 21, 2005

(30) Foreign Application Priority Data

Feb. 7, 2002 (AU) ..... PS0374

(51) Int. Cl.
*C10B 45/02* (2006.01)
*C10B 53/00* (2006.01)

(52) U.S. Cl. ..... 201/6; 264/122; 264/125; 264/126

(58) Field of Classification Search ..... 201/6; 264/122, 125, 126
See application file for complete search history.

(56) References Cited

U.S. PATENT DOCUMENTS 3,316,155 A * 4/1967 Holowaty et al. ..... 201/6
3,546,076 A * 12/1970 Muller et al. ..... 201/6
4,104,129 A 8/1978 Fields et al.
4,221,570 A 9/1980 Wasson
4,234,386 A * 11/1980 Stirling ..... 201/6
4,419,186 A * 12/1983 Wienert ..... 201/6

FOREIGN PATENT DOCUMENTS

| | | |
|---|---|---|
| CN | 1236802 | 12/1999 |
| GB | 1 577 212 | 5/1978 |
| GB | 2 085 915 A | 5/1982 |
| GB | 2 161 175 A | 1/1986 |

OTHER PUBLICATIONS

"High temp. treatment of carbonaceous material, e.g. anthracite- by drying, preheating and zonal heating". *Derwent Publications Ltd.*, Coke Chem Ind. 05805A/03 Jul. 12, 1977.

"Granulated petroleum coke processing for use as anone filler etc. — includes drying raw fragmented coke and then heating in fluidised bed with flue gas in two stages to increase yield". *Derwent Publications Ltd.* UFA Petroleum Inst. 22777 D/13 Jul. 15, 1980.

"Metallurgical coke prodn.—involves an initial steam heating stage adjusted to regulate water content to prod."*Derwent Publications Ltd.* Nippon Kokan KK (Keih-) 62045 K/26 May 18, 1983.

* cited by examiner

*Primary Examiner*—N. Bhat
(74) *Attorney, Agent, or Firm*—Merchant & Gould P.C.

(57) ABSTRACT

A process and plant for producing metallurgical coke is disclosed. The process comprises rapidly drying coal particles in an inert atmosphere, and maintaining the particles, once dry, in an inert atmosphere. The dried particles are then compressed into a briquette without addition of a binder. The briquette is heated to a temperature between 1000° C. and 1400° C. for a period of between 1 and 5 hours to produce metallurgical coke.

18 Claims, 1 Drawing Sheet

PROCESS OF PRODUCING METALLURGICAL COKE

Figure 1:
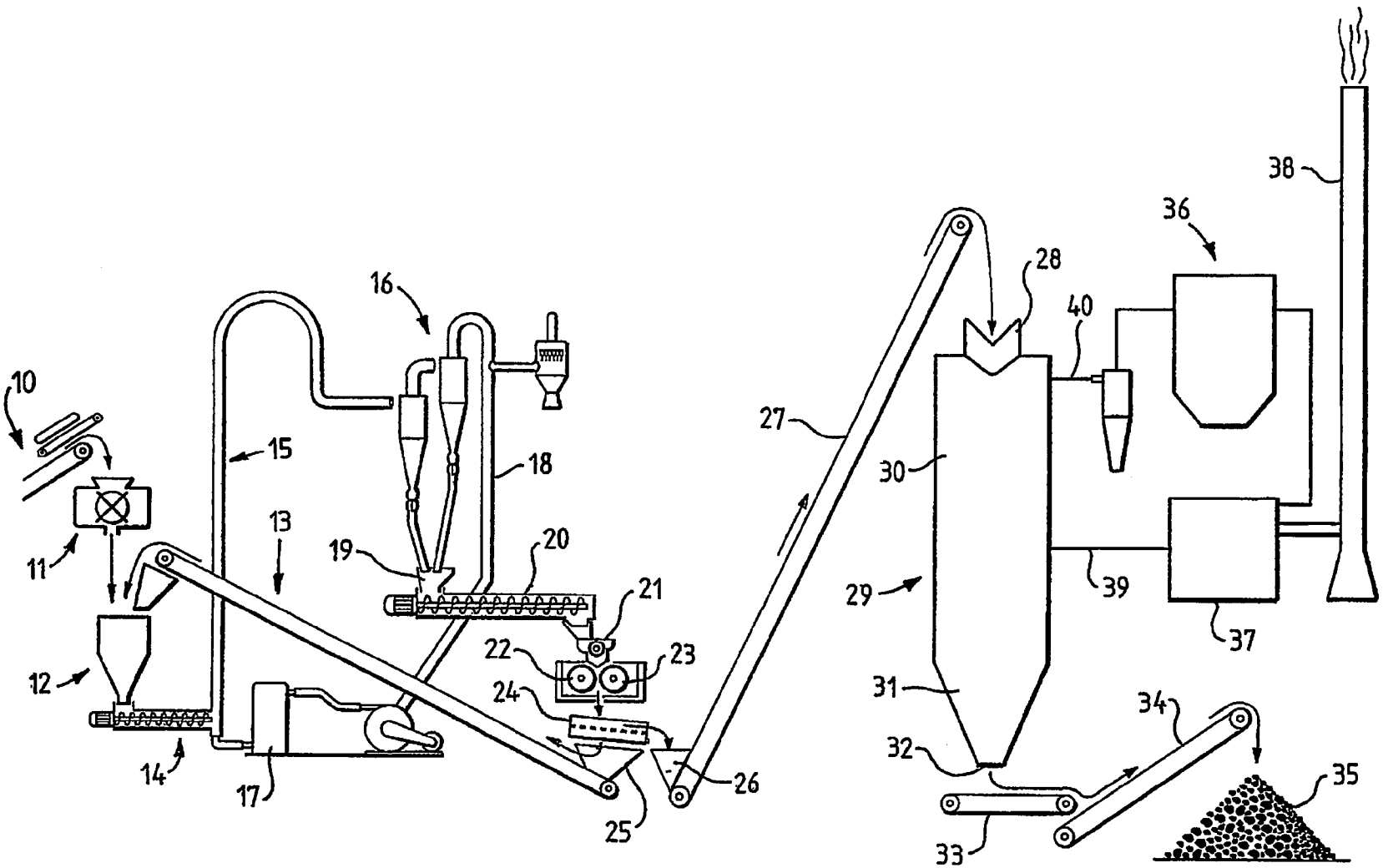

The present invention is concerned with the production of metallurgical coke and, in particular, the production of metallurgical coke from low rank coals.

In spite of the current interest in direct production technologies and electric arc furnaces, it would seem that there is likely to be heavy dependence world wide on conventional blast furnace technology for the production of steel well into the next century. Even with the increasing use of pulverised coal injection, this will necessitate an on-going need to produce large quantities of coke. The Japanese, for instance, estimate that over 70% of their steel will be produced via blast furnaces in the year 2020.

Although conventional coke ovens have a long service life, many will reach the stage where they require replacement within the next 10 to 15 years. Thus the Japanese are projecting a massive shortage of coke early in the next century.

Currently metallurgical coke for steel making is produced batchwise in coke oven batteries using technology which, apart from minor refinements, has been generally unchanged over the last 50 years. Since this is a batchwise process, the coke oven batteries are relatively low productivity units. Typically they require 12 to 24 hours to produce a batch of coke. Furthermore, their design includes numerous doors and vents, necessary due to the batchwise nature of the process, which makes it difficult for them to meet the stricter environmental standards which Governments, regulatory bodies and the community are demanding of industry. In order to produce metallurgical coke in such conventional processes it is necessary to select the coal carefully. Usually, high volatile coal is blended with either or both medium- and low-volatile coals to provide the charge for the coke ovens. These coals should contain as small an amount of sulphur and ash as is economically feasible. Coal preparation is also important and an excess of fine coal, as produced in the intensified mining methods frequently used today, can create difficulties in conventional coke oven batteries.

As indicated above, the production of metallurgical coke requires a very specific grade of coal, and this grade of coal represents only a small fraction of the world's coal resources. Consequently, many countries which have substantial coal reserves are still forced to import coal if they wish to produce metallurgical coke. For example, Indonesia has very large reserves of high purity sub-bituminous coal but has very little coking coal. In an attempt to reduce sulphur emissions, the USA relies heavily on its huge resources of sub-bituminous coal for power generation rather than burning its high sulphur bituminous coals. However, coke for its steel industry can only be made from some of these bituminous coals, hence sulphur emissions are a problem in coking plants.

Because of the relative scarcity of good coking coals, these coals attract a significant higher price than lower rank coals. Typically coking coal costs $60 to $70 per tonne for coking coal compared to $30 to $50 for sub-bituminous coals. Thus there is considerable economic incentive to use low rank coals instead of coking coals where possible.

Continuous processes for producing metallurgical coke have been proposed. One example is a process developed in the USA, the CTC process.

In the CTC process, char is produced at 600° C. in a twin screw mild gasification reactor in the first stage, followed by blending of the char with various hydrocarbon binders, briquetting the mixture of char and binder into various sizes and shapes and calcining the briquettes in a rotary furnace or tunnel kiln at 1200° C. The process, which has been under development since 1982, can reportedly produce high quality coke in a continuous manner within 2 hours in a totally enclosed system. A 10 tonne per day pilot plant is currently operating but the technology is so far unproven.

There have been many attempts to produce metallurgical coal from poor or non-coking coals, usually bituminous coals. Typically, the first step is the partial carbonising of the coal and the resultant char is mixed with pitch-type binders (often at high temperatures) and briquetted. The briquettes are further pyrolised to produce coke, which is generally referred to as form-coke.

In one such process, finely pulverised coking or non-coking coal is dried and partially oxidised with steam or air in a fluidised-bed reactor. The reactor product is carbonised in two stages at successively higher temperatures to obtain a char. The char is mixed with a pitch-type binder obtained in the carbonisation stages and briquetted in roll presses. The "green" briquettes are cured at low temperature, carbonised at high temperature and finally cooled in an inert atmosphere to produce a metallurgical coke of low volatile content.

Form-cokes have not seen commercial acceptance, largely because of inadequate properties and high production costs. Poor physical properties, in particular low strength, appear to be a result of the inability for a suitable structure to be developed at the high heating rates used.

When companies are forced to install new cokemaking units early in this century, they will inevitably be looking to units which can overcome some of the limitations of conventional coke ovens. There is therefore a need to develop new technologies for coal making which provide a higher productivity and are able to meet the tighter environmental standards which will inevitably be applied to new installations. One of the most attractive means of achieving these objectives is through the development of a continuous cokemaking process employing rapid carbonisation kinetics through improved heat transfer mechanisms to maximise productivity. However, the metallurgical coke produced in such a process must be physically strong to withstand breakage and abrasion during handling and should be able to use low rank coals and coals with a high proportion of fines as well as coking coals. The present invention allows low cost, widely available non-coking coals, in particular sub-bituminous coals, to be formed into coke with favourable physical properties.

According to a first aspect of the present invention there is provided a process for preparing metallurgical coke comprising the steps of:

(i) providing a plurality of coal particles;

(ii) rapidly drying said particles in an inert atmosphere, and maintaining said particles, once dry, in an inert atmosphere;

(iii) compressing said particles into a briquette without addition of a binder;

(iv) heating said briquette to a temperature between 1000° C. and 1400° C. for a period of between 1 and 5 hours; and (v) collecting said metallurgical coke.

Preferably said particles are compressed into a briquette in a two-stage process, the first stage comprising a pre-compression stage in which said particles are forced into a briquetting zone. Typically a standard pre-compaction screw is used to force said particles into said briquetting zone, thereby compressing them to some degree.

The briquetting zone is typically the nip zone between two briquetting rolls. The rolls are loaded such that the force on the rolls is between 20 and 80 kN per cm of roll width, preferably 50 kN per cm.

Typically said briquette is heated in a furnace.

Preferably the briquettes are transferred directly and without delay to said furnace. Advantageously, said briquettes are transferred through a small surge bin.

In a particularly preferred embodiment, said furnace is a shaft furnace. Any of the shaft furnaces of a conventional design such as used for direct reduction of iron ore is suitable. Typically the atmosphere within said shaft furnace consists of an inert or reducing gas or gas mixture. This will often be a mixture of nitrogen, hydrogen and carbon monoxide. Preferably the gas mixture is rich in carbon monoxide, and may comprise up to 95% carbon monoxide.

Advantageously, the metallurgical coke produced in said furnace is cooled in an inert or reducing gas atmosphere. Preferably, this happens in the bottom section of the shaft furnace. Cooled metallurgical coke can then be collected by withdrawing it from the bottom of said furnace.

Preferably, the drying step comprises exposing said coal particles to a hot gas stream in a gas flash dryer, but a fluidised bed reactor could be used to dry the particles. Typically the gas stream in the gas flash dryer is at a temperature around 320° C. and the particles are exposed to said hot gas stream for around 2-5 seconds. The drying gas consists predominantly of water vapour, carbon dioxide and nitrogen, with less than 5% oxygen. Generally the coal will be heated to no more than 130° C. in this step.

Advantageously, the coal is crushed in a mechanical crusher such as a roll crusher or a hammer mill prior to drying. The coal is, advantageously, crushed to particles less than 4 mm in diameter in this stage.

According to a second aspect of the present invention there is provided a plant for preparing metallurgical coke comprising:

(i) a means for rapidly drying coal particles in an inert atmosphere, and maintaining said particles, once dry, in an inert atmosphere;

(ii) a means for compressing said particles into a briquette without addition of a binder; and (iii) a means for heating said briquette to a temperature between 1000° C. and 1400° C. for a period of between 1 and 5 hours to produce metallurgical coke.

Preferably the drying means is a gas flash dryer for exposing said coal particles to a hot gas stream.

Preferably the compressing means comprises a means for pre-compressing the particles and a means for forming a briquette from the pre-compressed particle.

More preferably the compressing means comprises a pre-compaction screw for pre-compressing the particles and two briquetting rolls for forming a briquette from the pre-compressed particles, with the pre-compaction screw being arranged to force the pre-compressed particles into the nip between the rolls.

Preferably the heating means is a furnace, such as a shaft furnace.

A preferred embodiment of the invention will now be described with reference to the accompanying figure, FIG. 1, which is a flow sheet of a metallurgical coke-making process and plant in accordance with the present invention.

A particularly preferred process and plant is illustrated schematically in FIG. 1.

In the first step of the process, moist coal is fed by conveyor 10 to the coke making apparatus. The coal delivered by conveyor 10 is typically sub-bituminous coal which is not suitable for use in conventional coke oven batteries to prepare metallurgical coke. However, the coal may be coking coal or may be a mixture of low rank coals and coking coals.

Coal fed from conveyor 10 passes into crusher 11. Typically the crushing stage would reduce very large lumps of coal to particles less than 4 mm in diameter. The crushing apparatus is typically a hammer mill or a roll crusher. From the crusher 11, the coal particles are passed to surge bin 12. Conveyor 13 also delivers fines from the briquetting process back to the surge bin 12 for recycling through the process.

The crushed coal particles emerge from surge bin 12 into screw feed 14 whereupon they are rapidly drawn into gas recycling flash dryer 15. The crushed coal resides in the flash dryer 15 for only 2-5 seconds, in which time it is exposed to a hot gas stream consisting of water vapour, carbon dioxide and nitrogen with less than 5% oxygen at a temperature of 320° C. The dry particles emerge from flash dryer 15 at a temperature between 90° C. and 110° C. so no volatile hydrocarbons are released to the atmosphere. The dry particles then pass into separating cyclones 16 which separate the particles from the drying gas and return the drying gas to the drying gas heater 17 via conduit 18.

The dry particles are passed from cyclones 16 into bin 19 and thence into enclosed screw feed 20. Both the bin 19 and screw feed 20 have an inert gas atmosphere to prevent exposure of the dried particles to atmospheric oxygen and water vapour. The screw feed 20 introduces the dried coal particles to a pre-compaction screw 21 which forces the particles into the nip zone between two briquetting rolls 22, 23. The rolls are loaded such that the force on each is 50 kN per cm of roll width. The briquettes, once formed, drop onto screen 24 and roll from screen 24 into collector 26. Any fine particles not formed into briquettes pass through screen 24 into collector 25 and are carried back to surge bin 12 by conveyor 13.

Collector 26 conveys the briquettes by conveyor belt 27 to surge bin 28 located on the top of shaft furnace 29. The shaft furnace is a conventional shaft furnace comprising heating zone 30, cooling zone 31 and outlet 32. The furnace has an inlet 39 for heated gas and an outlet 40 for venting gas. Vented gas is recycled through gas cleaning apparatus 36 to gas heating and conditioning apparatus 37 where it is split into a feed gas and a fuel gas portion. The fuel gas portion is combusted and the heat from combustion heats the feed gas portion. The resulting hot feed gas is passed back to furnace 29 through inlet 39 to heat the furnace. Gases from the combustion step are vented through stack 38.

The briquettes remain in heating zone 30 of the shaft furnace 29 for 1-5 hours. In this time the volatile components of the briquettes distill out to produce coke. This is a comparatively short coking time so productivity is high. Furthermore, all carbonisation is performed in one shaft furnace so capital costs are low and emission control is simplified.

It is notable that there is rapid carbonisation in a shaft furnace since heat is transferred directly from reformed gases to the briquettes, whereas in conventional coke ovens heat is transferred slowly and indirectly from the walls of the oven as the walls heat up. Nonetheless, rapid heating does not result in poor physical properties in this case. In conventional coking processes the coal becomes fluid at one point and in this state evolves gases which form bubbles, and these are more common and larger when the coking coal is subject to rapid heating. This invention utilises much higher heating rates than conventional processes but, because the coal does not go through a significant fluid phase, weakening of the structures through gas bubbles does not occur.

Once the coke is produced, it passes into the cooling zone 31 of furnace 29 where it is cooled in an inert or reducing atmosphere. The coke exits the furnace via outlet 32 and is carried by conveyors 33 and 34 to coke stockpile 35.

The resulting product is a dense coke briquette with about 50% of the volume of the coal briquette from which it is formed. Typical properties are a reactivity of 16-30 g/g/s×

$10^{-6}$ compared to 15-27 for a traditional coke from Curragh coal and 100-155 for a sub-bituminous coal char. The crush strength of the coke briquette produced in the process is 70-80 kg $cm^2$ (with the force being applied along the line of the longest axis) and it has an apparent density (water immersion) of approximately 1.4 g $cm^{-1}$. It is notable that the briquettes shrink and do not become sticky during coking, resulting in a free flowing bed in the reactor.

It will be appreciated that variations and modifications may be made to the specific form of the invention described, and these variations and modifications form a part of the invention.

The invention claimed is:

1. A process for preparing metallurgical coke comprising the steps of:

(i) providing a plurality of coal particles;

(ii) rapidly drying said particles in an inert atmosphere by exposing said particles to a hot gas stream in a flash dryer for about 2 to about 5 seconds, wherein the coal is heated to no more than about 130° C., and maintaining said particles, once dry, in an inert atmosphere;

(iii) compressing said particles into a briquette without addition of a binder;

(iv) heating said briquette in a shaft furnace to a temperature between 1000° C. and 1400° C. for a period of between 1 and 5 hours; and (v) collecting said metallurgical coke.

2. The process defined in claim 1 wherein the briquetting step (iii) comprises compressing said particles into a briquette in a two-stage process, with the first stage comprising pre-compressing said particles and the second stage comprising forming said pre-compressed particles into a briquette, and with the pre-compression stage comprising forcing said pre-compressed particles into a briquetting zone for forming said pre-compressed particles.

3. The process defined in claim 2 wherein the pre-compression stage comprises pre-compressing said particles in a pre-compaction screw, thereby compressing the particles to some degree.

4. The process defined in claim 2 wherein said briquetting zone is nip zone between two briquetting rolls.

5. The process defined in claim 4 comprises loading the rolls such that the force on the rolls is between 20 and 80 kN per cm of roll width.

6. The process defined in claim 4 comprises loading the rolls such that the force on the rolls is 50 kN per cm of roll width.

7. The process defined in claim 1 further comprises transferring said briquette directly and without delay to said furnace.

8. The process defined in claim 7 comprises transferring said briquette to said furnace through a surge bin.

9. The process defined in claim 1 wherein the heating step (iv) comprises heating said briquette within said shaft furnace in an atmosphere that consists of an inert or a reducing gas or a gas mixture of an inert gas or a reducing gas.

10. The process defined in claim 9 wherein the gas mixture is a mixture of nitrogen, hydrogen and carbon monoxide.

11. The process defined in claim 10 wherein the gas mixture is rich in carbon monoxide.

12. The process defined in claim 11 wherein the gas mixture comprises up to 95% carbon monoxide.

13. The process defined in claim 1 comprises cooling the metallurgical coke produced in said furnace in an inert or reducing gas atmosphere.

14. The process defined in claim 13 comprises cooling the metallurgical coke in a bottom section of the furnace.

15. The process defined in claim 14 comprises collecting cooled metallurgical coke by withdrawing it from the bottom section of said furnace.

16. The process defined in claim 1 wherein the drying gas consists predominantly of water vapour, carbon dioxide and nitrogen, with less than 5% oxygen.

17. The process defined in claim 1 comprises crushing the coal in a mechanical crushing means such as a roll crusher or a hammer mill to form said particles prior to drying said particles in the drying step (ii).

18. The process defined in claim 17 comprises crushing the coal to form particles less than 4 mm in diameter.

* * * * *